US005956861A

United States Patent [19]

Barnes

[11] Patent Number: 5,956,861

[45] Date of Patent: Sep. 28, 1999

[54] WALL MOUNTED PORTABLE HAIR DRYER HOLDER

[76] Inventor: Jeffrey R. Barnes, 248 Tranquillo Rd., Pacific Palisades, Calif. 90272

[21] Appl. No.: 09/182,596

[22] Filed: Oct. 30, 1998

[51] Int. Cl.[6] ..... F26B 19/00

[52] U.S. Cl. ..... 34/90; 34/91; 34/97; 248/160; 248/910

[58] Field of Search ..... 34/90, 91, 96, 34/97; 248/284.1, 288.31, 314, 315

[56] References Cited

U.S. PATENT DOCUMENTS

| | | | |
|---|---|---|---|
| 4,225,106 | 9/1980 | Eplan | 248/309 R |
| 4,453,695 | 6/1984 | Sennott et al. | 248/660 |
| 4,712,313 | 12/1987 | Gettleman | 34/97 |
| 5,613,305 | 3/1997 | Narrin | 34/90 |
| 5,737,847 | 4/1998 | Britton | 34/97 |
| 5,761,825 | 6/1998 | Ammon et al. | 34/97 |
| 5,832,624 | 11/1998 | Narrin | 34/97 |
| 5,842,670 | 12/1998 | Nigoghosian | 248/160 |

*Primary Examiner*—Henry Bennett
*Assistant Examiner*—Pamela A. Wilson
*Attorney, Agent, or Firm*—Jack C. Munro

[57] ABSTRACT

A wall mounted portable hair dryer holder which takes the form of a wall mounted bracket from which pivotly extends a flexible walled tube with the outer end of the tube being connected to a base ring. The main body section of the hair dryer, which is the fan and heater housing of the hair dryer, is to be fixedly secured to a mounting ring with this mounting ring being then pivotly mounted onto the base ring. The handle of the hair dryer is to be insertable through an enlarged center through hole between the base ring and the mounting ring. The result is the hair dryer can be moved practically to any desired position permitted by the flexible walled tube and then adjusted to any specific position by pivoting of the mounting ring relative to the base ring and also pivoting of the base ring relative to the flexible walled tube.

3 Claims, 2 Drawing Sheets

WALL MOUNTED PORTABLE HAIR DRYER HOLDER

BACKGROUND OF THE INVENTION

1) Field of the Invention

The field of this invention relates to a holder for mounting of a hair dryer that permits the hair dryer to be used without the supporting of the hair dryer by the user's hands thereby leaving the user's hands free to perform other tasks.

2) Description of the Prior Art

The use of hair dryers by both men and women have long been known. The conventional hair dryer is deemed to be portable and is constructed in a manner to be relatively small in size having a fan and heater housing through which heated air is to be blown from the hair dryer which is to be directed at a desired location by the user holding onto a graspable handle section of the hair dryer. One of the many problems associated with the use of such hair dryers is that certain individuals, especially women, absolutely need to use both of their hands in manipulating and drying of the hair in order to cause the hair to be formed into a certain style. As a result, there is a need for some type of structure that will cantileverly support the hair dryer in a suspended position permitting air flow of the hair dryer to be directed to a desired direction leaving the user's hands free for styling and combing of the hair.

Many hair styles require the use of both hands of a person in order to comb and brush the hair to produce the desired hair style. This can be easily accomplished if two people are involved in the procedure. However, in most instances in the home, only a single individual is involved, that being the person obtaining the hair style.

In the past, in order to provide a "hands free" using relationship of hair dryer, it has been known to mount the hair dryer at a fixed location on a wall surface. The undesirable part of this mounting arrangement for a hair dryer is that the hair dryer is not adjustable in position. The user is required to maneuver and position his or her hair directly adjacent the output end of the hair dryer in order to effectively use the hair dryer.

Also, within the prior art, it has been known to cantileverly support a hair dryer from some type of bracket assembly relative to a vertical wall surface. These bracket assemblies permit universal moving and adjusting of the hair dryer to practically any desired position. However, these bracket assemblies in the past have been rather complex in construction. Also, these bracket assemblies have not been able to be connected with virtually every type of hair dryer as these bracket assemblies may only be connectable with certain types of hair dryers.

SUMMARY OF THE INVENTION

One of the primary objectives of this invention is to construct a wall mounted portable hair dryer holder which is easily and quickly connectable in a secure manner to practically any type of portable hair dryer.

Another objective of the present invention is to construct a wall mounted portable hair dryer holder that is constructed of relatively few parts and therefore is non-complex in construction and can be manufactured at a relatively inexpensive cost thereby permitting sale of the holder to the consumer at also a reasonable cost.

A primary objective of the present invention is to construct a wall mounted portable hair dryer holder which permits a hair dryer to be used in a conventional "hands free" manner that overcomes the shortcomings of prior art hair dryer holders.

Another objective of the present invention is to construct a cantilevered wall mounting for the hair dryer holder that permits ease of detachment and storage when not in use.

The wall mounted portable hair dryer holder of the present invention utilizes a mounting ring that has an enlarged center through hole. The mounting ring has strap connections with a mounting strap to be connected to the strap connections. The blower/heater housing of a hair dryer is to be mounted on the mounting ring with the handle of the hair dryer extending through the enlarged center through hole. The strap is then to be used to securely mount the blower/heater housing of a hair dryer onto the ring. The mounting ring is then pivotally mounted onto a base ring. The mounting ring is capable of three hundred sixty degree pivoting movement relative to the base ring. The base ring is pivotally mounted onto the outer end of a flexible walled tube. The inner end of the flexible walled tube is pivotally mounted to a wall bracket. The wall bracket is then to be fixedly secured to a wall surface. The flexible walled tube permits movement of the hair dryer to substantially any desired cantileverd position and will remain in that position when left unattended. By the combination of the pivot connections between the flexible walled tube and the wall bracket, the flexible walled tube and the base ring, and the pivot connection from the base ring and the mounting ring, any desired position within reason can be selected by the user which will permit the hair dryer to be operated in that position.

DETAILED DESCRIPTION OF THE PREFERRED EMBODIMENT

Figures 1, 2:
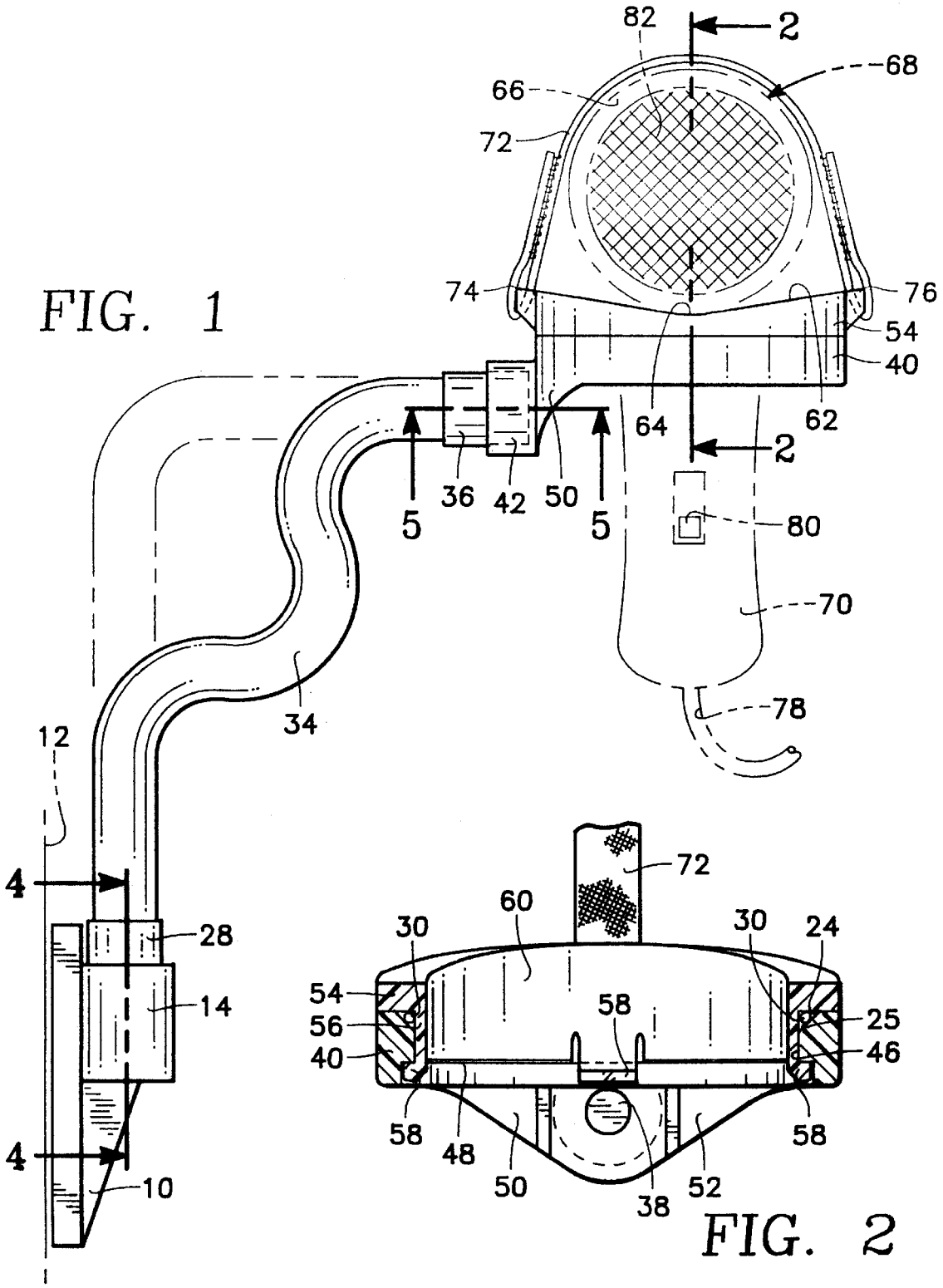
FIG. 1 is a side elevational view of the wall mounted portable hair dryer holder of the present invention showing the holder connected to a conventional hair dryer.
FIG. 2 is a cross-sectional view of the wall mounted portable hair dryer holder of the present invention through the base ring and mounting ring which is used to support the hair dryer taken along line 2—2 of FIG. 1.
Figure 3:
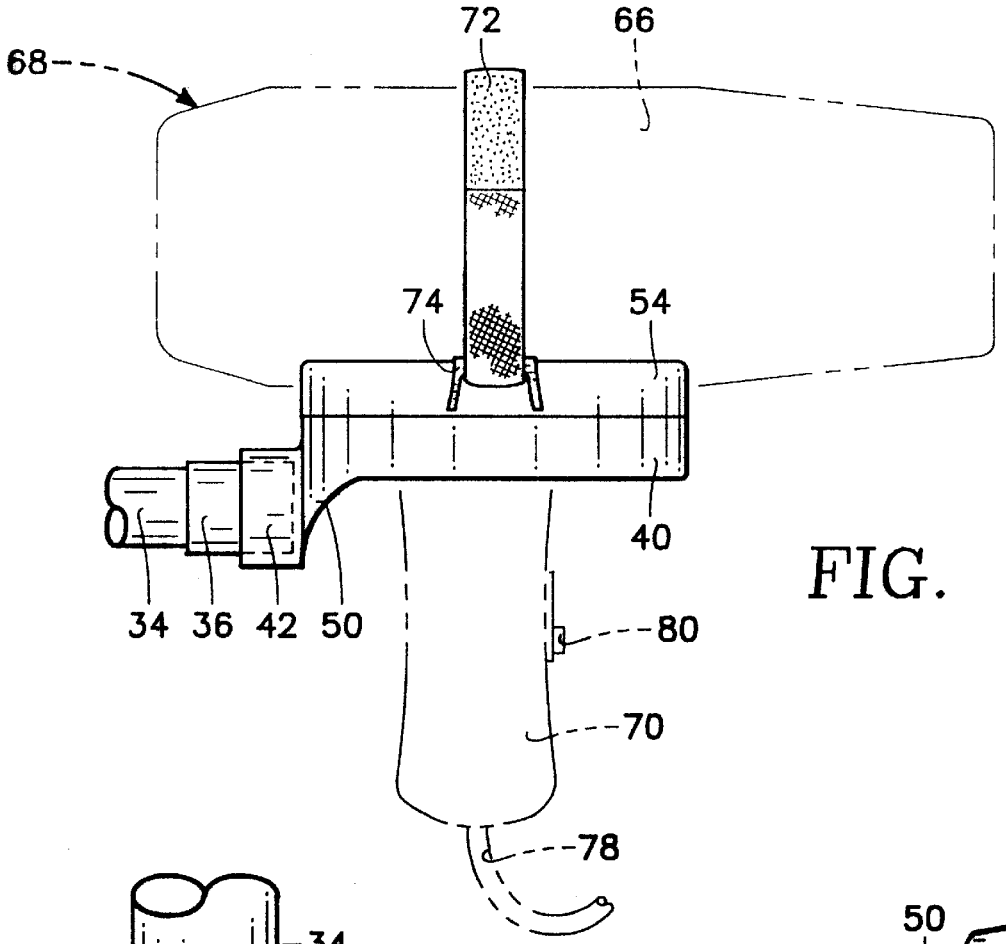
FIG. 3 is a side elevational view of the wall mounted portable hair dryer holder of the present invention similar to FIG. 1 of the outer portion of the holder that is used to support a hair dryer showing the hair dryer in a ninety degree displaced position to that in FIG. 1.
Figure 4:
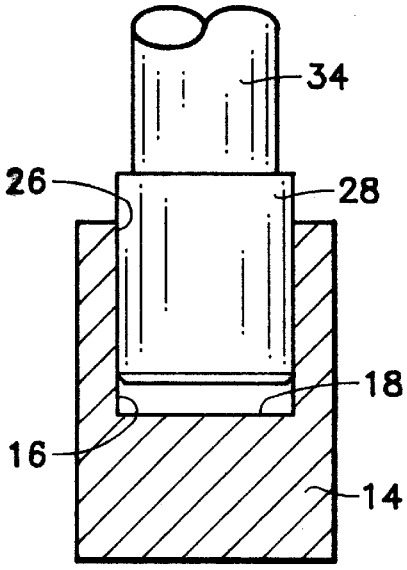
FIG. 4 is a cross-sectional view through a portion of the wall bracket that is utilized to mount the hair dryer holder of the present invention to a wall taken along line 4—4 of FIG. 1.
Figure 5:
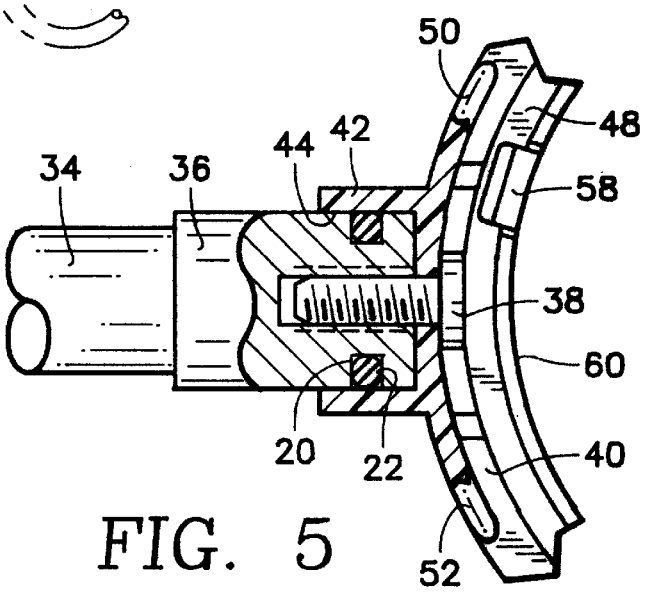
FIG. 5 is a cross-sectional view taken along 5—5 of FIG. 1 showing in more detail the pivot connection established between the base ring and the flexible walled tube of the hair dryer holder of the present invention.

Referring particularly to the drawings, there is shown in FIG. 1 a wall bracket 10 that is to be permanently installed by adhesive or mechanical fasteners (not shown) to a conventional wall surface 12. The wall bracket 10 includes a tubular mount 14 which has an internal cavity 16. The internal cavity 16 is open to the ambient by access opening 26. A plug 28 is to be insertable through the access opening 26 in a close fitting manner and located within the internal cavity 16. The plug 28 is to be inserted within the internal cavity 16 until the forward end of the plug 28 is located against wall 18 of internal cavity 16. The plug 28 is capable of being pivoted relative to the tubular mount 14.

Integrally connected to the plug 28 is the inner end of a flexible walled tube 34. The flexible walled tube 34 would normally be about two to three feet in length. The flexible walled tube 34,is constructed of plastic and steel with the tube 34 being readily bendable to any desired shape or configuration, an example is shown in dotted lines in FIG. 1 of the drawing. The advantage of the flexible walled tube 34 is that when it is formed into a particular shape, it will remain in that shape until it is manually moved therefrom by being manually deformed again into another shape.

The outer end of the flexible walled tube 34 is attached to a plug 36. The plug 36 is attached by a fastener 38 to a base ring 40 with the base ring 40 including a connector 42 which includes a circular shaped recess 44. The plug 36 is to fit within the recess 44 in a close fitting manner but yet permit free pivoting movement of the connector 42 relative to the plug 36. The purpose of the fastener 38 is to maintain the plug 36 connected with the connector 42 but yet permit the pivoting of the base ring 40 relative to the plug 36. The plug 36 includes an annular groove 20 within which is mounted an o-ring 22. The o-ring 22 achieves a pivoting/resistance type of connection between plug 36 and connector 42. The pivot connection should be a relatively snug type of connection which means that the user will actually have to manually pivot the connector 42 relative to the plug 36 to the desired position, and once that desired position is achieved and the connector 42 is released, the connector 42 will remain in that established position.

The base ring 40 has an enlarged center through hole 46. The wall surface of the center through hole 46 includes an annular groove 48. In between the base ring and the connector 42 are formed a pair of spaced apart, smoothly contoured braces 50 and 52. It is between the braces 50 and 52 that the enlarged head of the fastener 38 is located. It is to be noted that the base ring will normally be constructed of a plastic material.

A plastic mounting ring 54 has an annular extension 56 which includes four in number of deflectable locking tabs 58. It is to be understood that the number of locking tabs 58 can be increased or decreased without departing from the scope of this invention. The annular extension 56 is to be inserted within the enlarged center through hole 46 and will actually cause the locking tabs 58 to deflect inwardly a small amount. The insertion of the mounting ring 54, when accomplished completely with the base ring 40, will result in the locking tabs 58 connecting with the annular groove 48 with the tabs 58 deflecting in an outward direction. This locking position is shown in FIG. 2. This results in the mounting ring 54 being connected together with the base ring 40 where the mounting ring 54 can readily pivot relative to the base ring 40. The pivoting of the mounting ring 54 is about a longitudinal axis of an enlarged through opening 60 formed through the mounting ring 54. It is desirable that the pivoting of mounting ring 54 be accomplished in a restricted manner. In order to achieve this the base ring 40 includes an annular taper 24. This provides an annular space 25 within which is located an O-ring 30. The O-ring 30, by being made of rubber or plastic, causes the desired restricted movement.

The upper surface of the mounting ring 54 is defined into a shallow V-shaped configuration 62. Within the apex 64 of this shallow V-shaped configuration 62 there is to be placed a conventional fan and heater housing 66 of a conventional hair dryer 68. The handle 70 of the hair dryer 68 extends through the enlarged through opening 60. It is to be noted that the longitudinal axis through the enlarged through opening 60 coincides with the center axis for the enlarged center through hole 46.

However, to make sure that the hair dryer does not accidentally disengage from its resting position on the mounting ring 54, a strap 72 is bound about the fan and heater housing 66, one end of the strap 72 passing through a strap loop 74 which is integrally mounted onto the mounting ring 54 with the other end of the strap 72 passing through a strap loop 76 again integrally mounted on the mounting ring 54. A typical configuration for the strap 72 would be a silicone strap or a strap that is commonly sold under the trade name of Velcro.

With the handle 70 inserted through the enlarged though opening 60 and the fan and heater housing 66 resting within the apex 64 of the V-shaped groove 62 and the strap 72 being snugly tightened about the fan and heater housing 66, the electrical supply cord 78 is not interfered with in conjunction with the handle 70. Also, access to the on/off switch 80, and other switches not shown, is readily permitted.

With the hair dryer 68 being mounted as previously mentioned in conjunction with the mounting ring 54, the hair dryer 68 can be operated as usual with the output end of the hair dryer 68 which includes screen 82 being pointed at any particular desired direction. Movement to any particular desired position is readily accomplished by the hair dryer 68 being pivotable three hundred sixty degrees by the mounting ring 54 relative to the base ring 40. Also, the base ring 40 is pivotable three hundred sixty degrees relative to the plug 36 with the pivot axis of this pivoting being at a right angle to the pivot axis between the mounting ring 54 and the base ring 40. The position of the hair dryer 68 relative to the wall 12 as well as its height above and below the bracket 10 is to be accomplished by bending of the flexible walled tube 34. Also, further pivoting action is permitted by the flexible walled tube 34 being readily pivotable relative to the tubular mount 14.

What is claimed is:

1. A wall mounted portable hair dryer holder comprising:

a wall bracket adapted to be fixedly secured to a vertical wall surface;

an elongated flexible walled tube having an inner end mounted by first connection means to said wall bracket, said flexible walled tube being readily manually bendable to assume a desired bent position and when left in said bent position, will remain in said bent position;

said elongated flexible walled tube having an outer end, said outer end being mounted by second connection means to a base ring, said base ring having an enlarged center through hole;

a mounting ring mounted within said enlarged center through hole of said base ring, said mounting ring being capable of being pivoted three hundred sixty degrees relative to said base ring, said mounting ring having an enlarged center through opening; and securement means mounted on said mounting ring, whereby a graspable handle of a hair dryer is to be inserted through said through opening with the fan and heater housing of the hair dryer to rest on said mounting ring, whereby said securement means is to be used to securely mount said mounting ring to the fan and heater housing of the hair dryer, whereby the hair dryer can be moved and pivoted to substantially any desired cantilevered position and will remain in that position permitting usage of the hair dryer without support by a user's hand.

2. The wall mounted portable hair dryer apparatus as defined in claim 1 wherein:

said second connection means comprising a pivot connection that permits three hundred sixty degrees pivot movement of said outer end of said tube relative to said base ring.

3. The wall mounted portable hair dryer apparatus as defined in claim 1 wherein:

said mounting ring having a shallow, V-shaped rest pocket into which the fan and heater housing of the hair dryer is to be located when mounted therewith.

* * * * *